US011542945B2

(12) United States Patent
Mikulic et al.

(10) Patent No.: US 11,542,945 B2
(45) Date of Patent: Jan. 3, 2023

(54) REFRIGERANT COMPRESSOR UNIT

(71) Applicant: BITZER Kuehlmaschinenbau GmbH, Sindelfingen (DE)

(72) Inventors: Tihomir Mikulic, Holzgerlingen (DE); Klaus Feller, Herrenberg (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 1098 days.

(21) Appl. No.: 16/151,961

(22) Filed: Oct. 4, 2018

(65) Prior Publication Data

US 2019/0032666 A1 Jan. 31, 2019

Related U.S. Application Data

(63) Continuation of application No. PCT/EP2016/057533, filed on Apr. 6, 2016.

(51) Int. Cl.

| | |
|---|---|
| ***F04C 29/04*** | (2006.01) |
| ***F04C 18/08*** | (2006.01) |
| ***F25B 31/00*** | (2006.01) |
| ***F04C 29/00*** | (2006.01) |
| ***F04B 39/12*** | (2006.01) |
| ***F04B 39/02*** | (2006.01) |
| ***F04C 14/28*** | (2006.01) |
| ***F04C 29/02*** | (2006.01) |
| ***F04C 28/28*** | (2006.01) |

(Continued)

(52) U.S. Cl.

CPC ..... *F04C 29/028* (2013.01); *F04B 39/0207* (2013.01); *F04B 39/0223* (2013.01); *F04B 39/0284* (2013.01); *F04B 39/121* (2013.01); *F04C 18/16* (2013.01); *F04C 28/06* (2013.01); *F04C 28/28* (2013.01); *F04C 2240/81* (2013.01); *F04C 2270/20* (2013.01); *F04C 2270/24* (2013.01)

(58) Field of Classification Search

CPC ..... F04C 18/16; F04C 29/028; F04C 29/02; F04C 29/0007; F04C 29/0014; F04C 28/06; F04C 14/28; F04C 2240/81; F04C 29/04; F04B 39/0207; F04B 39/0284; F04B 39/121; F25B 31/004

See application file for complete search history.

(56) References Cited

U.S. PATENT DOCUMENTS 5,341,658 A * 8/1994 Roach ..... F04C 29/0014 62/468

5,884,494 A * 3/1999 Okoren ..... F04C 28/28 62/193

(Continued)

*Primary Examiner* — Deming Wan

(74) *Attorney, Agent, or Firm* — Reinhart Boerner Van Deuren P.C.

(57) ABSTRACT

A refrigerant compressor unit, including a compressor housing and at least one compressor element that is arranged in the compressor housing, is movable by bearing and drive parts, and operates in at least one compressor chamber, at least one lubricant supply point arranged in the compressor housing for at least one of the bearing and drive parts and/or compressor element, and a lubricant supply line to the at least one lubricant supply point, wherein the lubricant supply line has a lubricant storage chamber through which lubricant flows and in which a lubricant presence sensor is arranged for detecting the presence of lubricant in the lubricant storage chamber.

26 Claims, 5 Drawing Sheets

(51) Int. Cl.
*F04C 18/16* (2006.01)
*F04C 28/06* (2006.01)

(56) References Cited

U.S. PATENT DOCUMENTS

| | | | | |
|---|---|---|---|---|
| 6,116,046 | A | 9/2000 | Leaver et al. | |
| 6,125,642 | A | 10/2000 | Seener et al. | |
| 7,116,095 | B2 * | 10/2006 | Takizawa | F16C 41/007 73/660 |
| 7,722,346 | B2 * | 5/2010 | Kishi | F04C 23/001 418/201.1 |
| 9,115,714 | B2 * | 8/2015 | Hattori | F04C 18/16 |
| 2009/0282985 | A1 * | 11/2009 | Whiteley | B01D 19/0031 96/204 |
| 2010/0307173 | A1 * | 12/2010 | Guo | F04C 18/0253 62/468 |
| 2016/0123325 | A1 | 5/2016 | Kim et al. | |

* cited by examiner

REFRIGERANT COMPRESSOR UNIT

CROSS-REFERENCE TO RELATED PATENT APPLICATION

This application is a continuation of International application number PCT/EP2016/057533 filed on Apr. 6, 2016.

This patent application claims the benefit of International application No. PCT/EP2016/057533 of Apr. 6, 2016, the teachings and disclosure of which are hereby incorporated in their entirety by reference thereto.

BACKGROUND OF THE INVENTION

The invention relates to a refrigerant compressor unit, including a compressor housing and at least one compressor element that is arranged in the compressor housing, is movable by bearing and drive parts, and operates in at least one compressor chamber, at least one lubricant supply point arranged in the compressor housing for at least one of the bearing and drive parts and/or compressor elements, and a lubricant supply line to the at least one lubricant supply point.

Refrigerant compressors of this kind are known from the prior art.

Conventionally, in these the lubricant supply is monitored by way of lubricant flow sensors, which bring about a drop in pressure in the lubricant supply.

However, sensors of this kind impair lubricant supply and do not provide the possibility of responding as quickly as possible to an interruption in the lubricant.

The object of the invention is therefore to improve a refrigerant compressor unit of the kind mentioned in the introduction such that optimum supply of lubricant is possible and it is possible to optimise the response to an interruption in lubricant.

SUMMARY OF THE INVENTION

This object is achieved according to the invention with a refrigerant compressor unit of the kind mentioned in the introduction in that the lubricant supply line has a lubricant storage chamber through which lubricant flows and in which a lubricant presence sensor is arranged for detecting lubricant in the lubricant storage chamber.

The advantage of the solution according to the invention can be seen in the fact that with this solution the lubricant is not detected by a drop in pressure but by the presence of lubricant in the lubricant storage chamber, with the result that this allows the supply of lubricant to be optimised, and in particular there is no need for a drop in pressure to detect the supply of lubricant, nor does a drop in pressure occur.

Here, the lubricant presence sensor could for example be a sensor that is cooled in the presence of lubricant and heats up in the absence of lubricant and hence provides the possibility of detecting the presence of lubricant.

However, it is particularly favourable if the lubricant presence sensor is an optical sensor.

In particular here, the optical lubricant presence sensor takes a form such that it is arranged with a sensor surface that detects the presence of lubricant adjacent to the lubricant storage chamber.

In particular with the solution according to the invention it is provided for the lubricant storage chamber to form, in relation to the rest of the flow sections of the lubricant supply line, an unthrottled section, and for example to take a form having a widened cross section by comparison with the rest of the flow sections of the lubricant supply line.

This ensures that the lubricant storage chamber and the detection of lubricant in the lubricant storage chamber by the lubricant presence sensor do not result in a drop in pressure.

As regards the form taken by the lubricant supply line, it has proved particularly advantageous if it stores a volume of lubricant that lies above the lubricant supply point, relative to the direction of gravity, that is to say that it is dimensioned to have a volume such that it is able to store the said volume of lubricant.

In particular here, it is provided for the lubricant storage chamber to accommodate at least some of the volume of lubricant to be stored.

Detailed statements have not been made as regards the dimensions of the volume of lubricant.

Here, it is particularly favourable if the lubricant volume of the lubricant supply line is at least large enough, in the event that the drive of the refrigerant compressor unit is switched off, to ensure that lubricant is supplied to the lubricant supply point without any further delivery of lubricant until the refrigerant compressor unit comes to a final standstill.

It is even better if the lubricant volume is at least large enough to ensure that lubricant is supplied to the lubricant supply point without any further delivery of lubricant until the refrigerant compressor unit is started up again.

In particular in the case of particularly sensitive lubricant supply points that are to be cooled by the lubricant, it is further provided for a lubricant outlet line to run from the lubricant supply point to the at least one compressor chamber of the compressor housing.

A lubricant outlet line of this kind is still in particular required if the lubricant supply point is to be not only sufficiently lubricated at all times but also sufficiently cooled at all times by the lubricant.

It is particularly favourable here if the lubricant outlet line has a lubricant storage chamber for receiving lubricant, with the result that the lubricant outlet line is also able to store lubricant.

As regards the form taken by the lubricant outlet line, it is likewise advantageous if the lubricant outlet line stores a volume of lubricant that lies above the lubricant supply point, relative to the direction of gravity, and which where appropriate is available for supplying the lubricant supply point in the event of an interruption in the lubricant supply.

Preferably, it is provided here for the lubricant storage chamber to accommodate at least some of the volume of lubricant to be stored.

This provides the possibility, in the event of an interruption in the lubricant supply, of also using the volume of lubricant that is provided in the lubricant outlet line for the purpose of lubricating the lubricant supply point.

Here, it is provided in particular for the lubricant volume of the lubricant outlet line to be at least large enough, in the event that the drive of the refrigerant compressor unit is switched off, to ensure that lubricant is supplied to the lubricant supply point without any further delivery of lubricant until the refrigerant compressor unit comes to a final standstill.

It is even more favourable if the lubricant volume is at least large enough to ensure that lubricant is supplied to the lubricant supply point without any further delivery of lubricant at least until the refrigerant compressor unit is started up again.

A particularly favourable solution provides for the lubricant volume of the lubricant supply line and the lubricant outlet line together to be at least large enough, in the event that the drive of the refrigerant compressor unit is switched off, to ensure that lubricant is supplied to the lubricant supply point without any further delivery of lubricant until the refrigerant compressor unit comes to a final standstill.

It is even better if the lubricant volume of the lubricant supply line and the lubricant outlet line together is at least large enough to ensure that lubricant is supplied to the lubricant supply point without any further delivery of lubricant at least until the refrigerant compressor unit is started up again.

More detailed statements have not yet been made as regards the arrangement of the lubricant supply line.

For example, the lubricant supply line could be formed by a separate line system arranged in the compressor housing.

However, it is particularly advantageous if the lubricant supply line is arranged integrated into the compressor housing, that is to say that it is formed by ducts and volumes that are integrated into the compressor housing.

Here, it is particularly favourable if the lubricant supply line is arranged in a wall region of the compressor housing that comprises the lubricant supply point.

Further, it is also advantageous as regards the formation of the lubricant outlet line if the lubricant outlet line is arranged integrated into the compressor housing.

Preferably, for this purpose it is provided for the lubricant outlet line to be arranged integrated into the compressor housing.

In this regard as well it is particularly favourable if the lubricant outlet line is arranged in the wall region of the compressor housing that accommodates the lubricant supply point.

More detailed statements have not yet been made as regards the supply of lubricant to the lubricant supply line.

Here, a particularly favourable solution provides for the lubricant supply line to be connected to a lubricant connector provided on the compressor housing and fed by a lubricant supply system, and to extend from the lubricant connector to the at least one lubricant supply point.

More detailed statements have not yet been made as regards the form taken by the lubricant supply point itself.

Here, various solutions provide for the lubricant supply point to be located at at least one of the following elements: a shaft seal unit, a bearing unit, the compressor element that operates in the compressor chamber, and a slider unit.

Further, for the purpose of setting the lubricant flow through the lubricant supply line, it is preferably provided for a throttling element to be provided in the lubricant supply line.

Similarly, it is favourable where appropriate if a throttling element is provided in the lubricant outlet line.

More detailed statements have not yet been made as regards operation of the refrigerant compressor unit in conjunction with the lubricant presence sensor.

Here, an advantageous solution provides for the lubricant presence sensor to be connected to a lubricant monitor which, in the event of an interruption in the supply of lubricant that is detected by the presence sensor, switches off a drive of the refrigerant compressor unit.

It would thus be conceivable for example for a coupling between the refrigerant compressor unit and a drive motor to be disconnected in order to switch off the refrigerant compressor unit as quickly as possible.

A particularly simple solution provides, in the event of an interruption in the supply of lubricant that is detected by the presence sensor, for the lubricant monitor to switch off the motor for driving the refrigerant compressor unit.

Further features and advantages of the invention form the subject matter of the description below and the representation in the drawing of some exemplary embodiments.

DETAILED DESCRIPTION OF THE INVENTION

Figure 1:
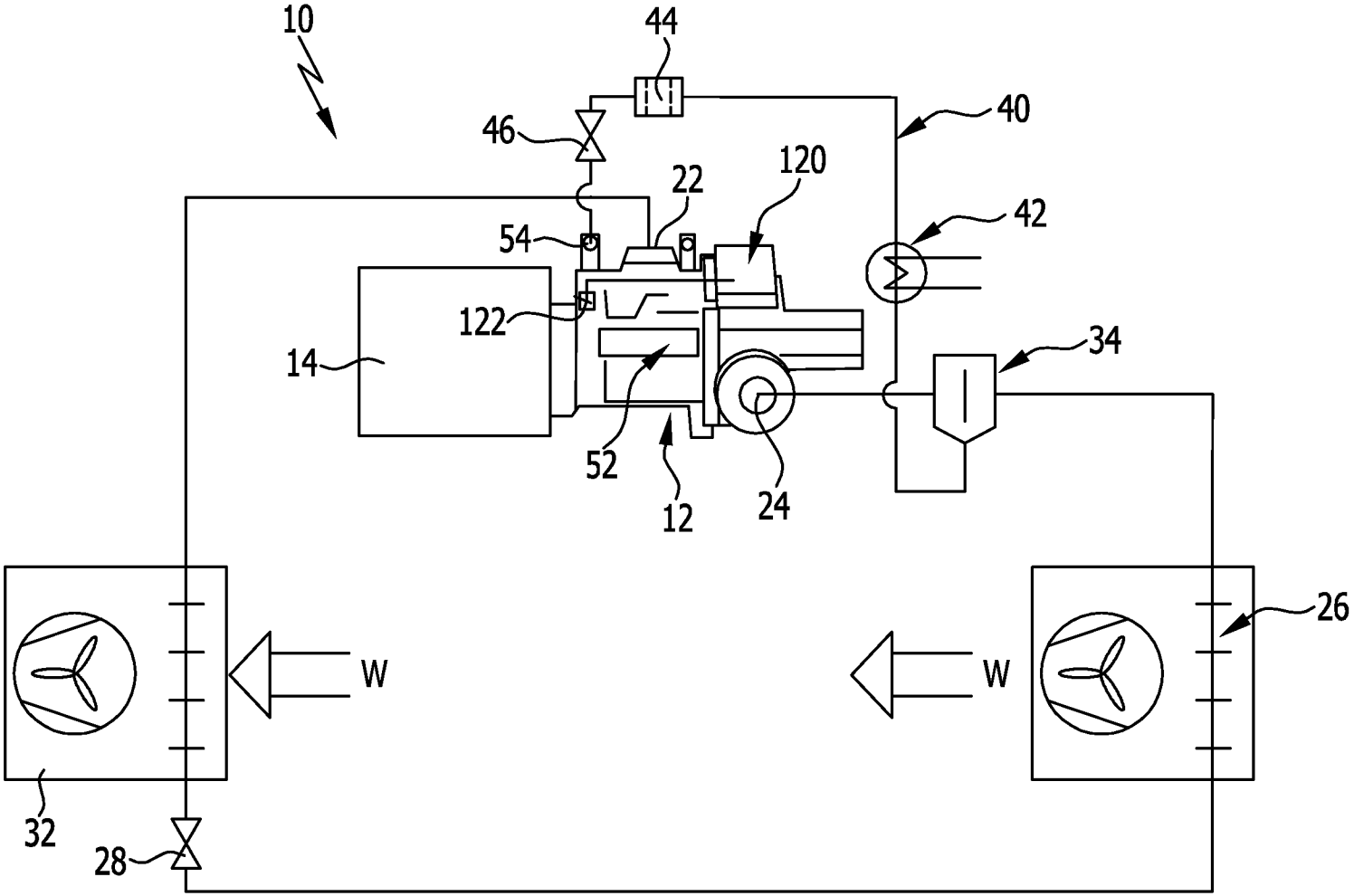
FIG. 1 shows an overall illustration of a refrigerant compressor unit arranged in a refrigerant compressor circuit, having a lubricant supply system.

Provided in a refrigerant circuit, which is illustrated in FIG. 1 and designated 10 as a whole, is a refrigerant compressor unit that is designated 12 as a whole and is driven by a motor 14.

The refrigerant compressor unit 12 compresses refrigerant that is supplied at a suction connector 22 and discharges it in the compressed condition at a pressure connector 24, wherein the refrigerant in the refrigerant circuit 10 is supplied downstream of the pressure connector 24 to a heat exchanger unit 26 in which heat W is discharged by the compressed refrigerant.

After the compressed refrigerant has flowed through the heat exchanger unit 26 and cooled, it flows to an expansion unit, designated 28 as a whole, in which the pressurised refrigerant is expanded, and thereafter it enters a heat exchanger unit 32, and therein is capable of taking up heat W.

After the refrigerant has flowed through the heat exchanger unit 32, it is supplied to the suction connector 22, for the purpose of being compressed in the refrigerant compressor unit 12.

Between the pressure connector 24 of the refrigerant compressor unit 12 and the heat-discharging heat exchanger unit 26 there is provided a lubricant separating device 34 that is designated 34 as a whole and that separates entrained lubricant out of the compressed refrigerant leaving the refrigerant compressor unit 12 by way of the pressure connector 24.

The lubricant that is separated out by the lubricant separating device 34 is supplied to the refrigerant compressor unit 12 again, for lubrication thereof, by a lubricant supply system 40.

For example, the lubricant supply system 40 includes a lubricant cooler 42 that cools lubricant coming from the lubricant separating device 34, and thereafter a lubricant filter 44 for filtering the lubricant, and a valve 46 for controlling the flow of lubricant in the lubricant supply system 40.

The lubricant is supplied by the lubricant supply system 40 to a compressor housing 52 of the refrigerant compressor unit 12 via a lubricant connector 54 and distributed within the compressor housing 52.

Figure 2:
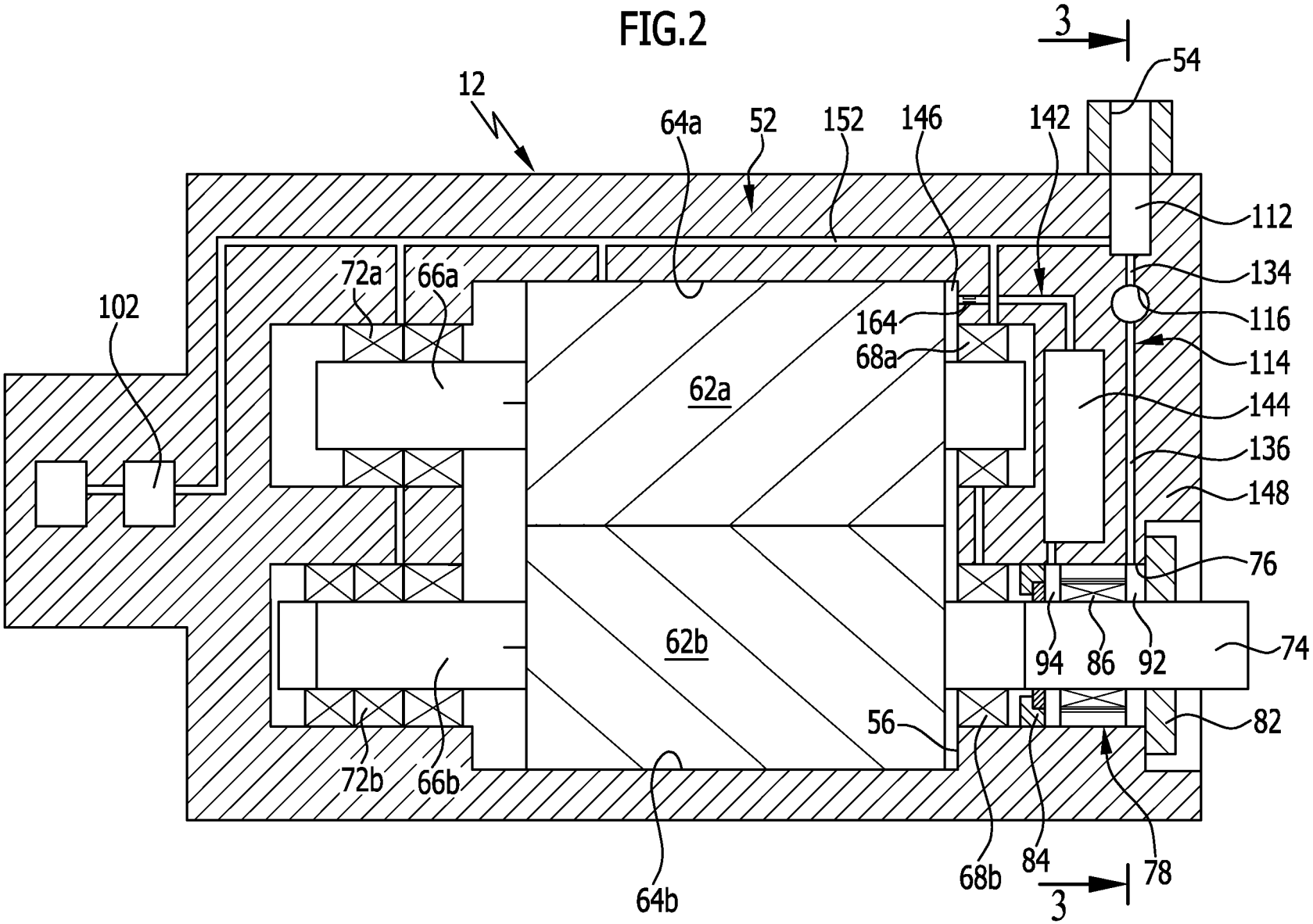
FIG. 2 shows a first example of a refrigerant compressor unit according to the invention, having a lubricant outlet line and lubricant supply lines formed in a compressor housing, in longitudinal section.

As illustrated in FIG. 2, in a first exemplary embodiment of a refrigerant compressor unit 12 according to the invention, two compressor elements 62*a*, 62*b*, for example in the form of helical rotors, are provided in the compressor housing 52, and these are respectively arranged in compressor chambers 64*a*, 64*b*, for example taking the form of helical rotor bores 64, 64*b* associated with these helical rotors.

The mutually meshing helical rotors 62*a*, 62*b* are for their part mounted rotatably in the compressor housing by means of helical rotor shafts 66*a*, 66*b*, wherein the helical rotor shafts 66*a*, 66*b* are mounted rotatably in the compressor housing 52, at one end in bearings 68*a*, 68*b* on the suction side and at the other in bearings 72*a*, 72*b* on the pressure side.

Further, the helical rotors 62*a*, 62*b* are driven by way of at least one drive shaft 74, which leads to one of the helical rotor shafts 66, and at one end is connected to the helical rotor shaft 66 and at the other leads out of the compressor housing 52 in order to be driven by the motor 14.

Here, the drive shaft 74 leads out of the compressor housing 52 through an opening 76 in the housing, and a shaft seal unit 78, which prevents refrigerant from escaping from a refrigerant-guiding interior chamber 56 in the compressor housing 52, is provided in the region of the housing opening 76 for the purpose of forming a seal between the drive shaft 74 and the housing opening 76.

The shaft seal unit 78 includes for example an outer sealing element 82, an inner sealing element 84 and a shaft seal 86 that lies between the outer sealing element 82 and the inner sealing element 84, wherein the outer sealing element 82 and the inner sealing element 84 serve to produce between them a lubricant chamber in which the shaft seal 86 is arranged and is thus constantly provided with lubricant.

Preferably, a lubricant supply chamber 92 for the shaft seal is formed between the outer sealing element 82 and the shaft seal 86, and a lubricant drainage chamber 94 is produced between the inner sealing element 84 and the shaft seal 86, with the result that the lubricant for the shaft seal 86 can enter the shaft seal 86 from the lubricant supply chamber 92 and escape therefrom into the lubricant drainage chamber 94.

A multiplicity of lubricant supply points are provided in the compressor housing 52.

Thus by way of example, the shaft seal unit 78 is a lubricant supply point.

By way of example, the bearings 68*a* and 68*b* on the suction side are a further lubricant supply point, wherein the lubricant under the pressure on the output side of the refrigerant compressor unit serves to operate cylinder arrangements for the purpose of moving control elements.

By way of example, the bearings 72*a* and 72*b* on the pressure side are also a lubricant supply point.

For example, the helical rotors 62*a* and 62*b* running in the helical rotor bores 64*a* and 64*b* are a further lubricant supply point.

By way of example, the slider units 102 for controlling output are a further lubricant supply point, wherein in particular the lubricant under the pressure on the output side of the refrigerant compressor unit serves to operate control elements such as cylinder arrangements operated with the pressurised lubricant.

All these lubricant supply points are lubricated by way of the lubricant supplied to the lubricant connector 54.

Here, lubricant is supplied to the individual lubricant supply points in the compressor housing 52 as a result of the pressure difference between the lubricant connector 54 and the pressure prevailing at the individual lubricant supply points, which is lower than the pressure in the lubricant supply system 40.

In the first exemplary embodiment, illustrated in FIG. 2, a connector chamber 112 is provided in the compressor housing 52, downstream of the lubricant connector 54.

Preferably, the connector chamber 112 lies above all the lubricant supply points of the compressor housing 52, relative to the direction of gravity.

Figure 3:
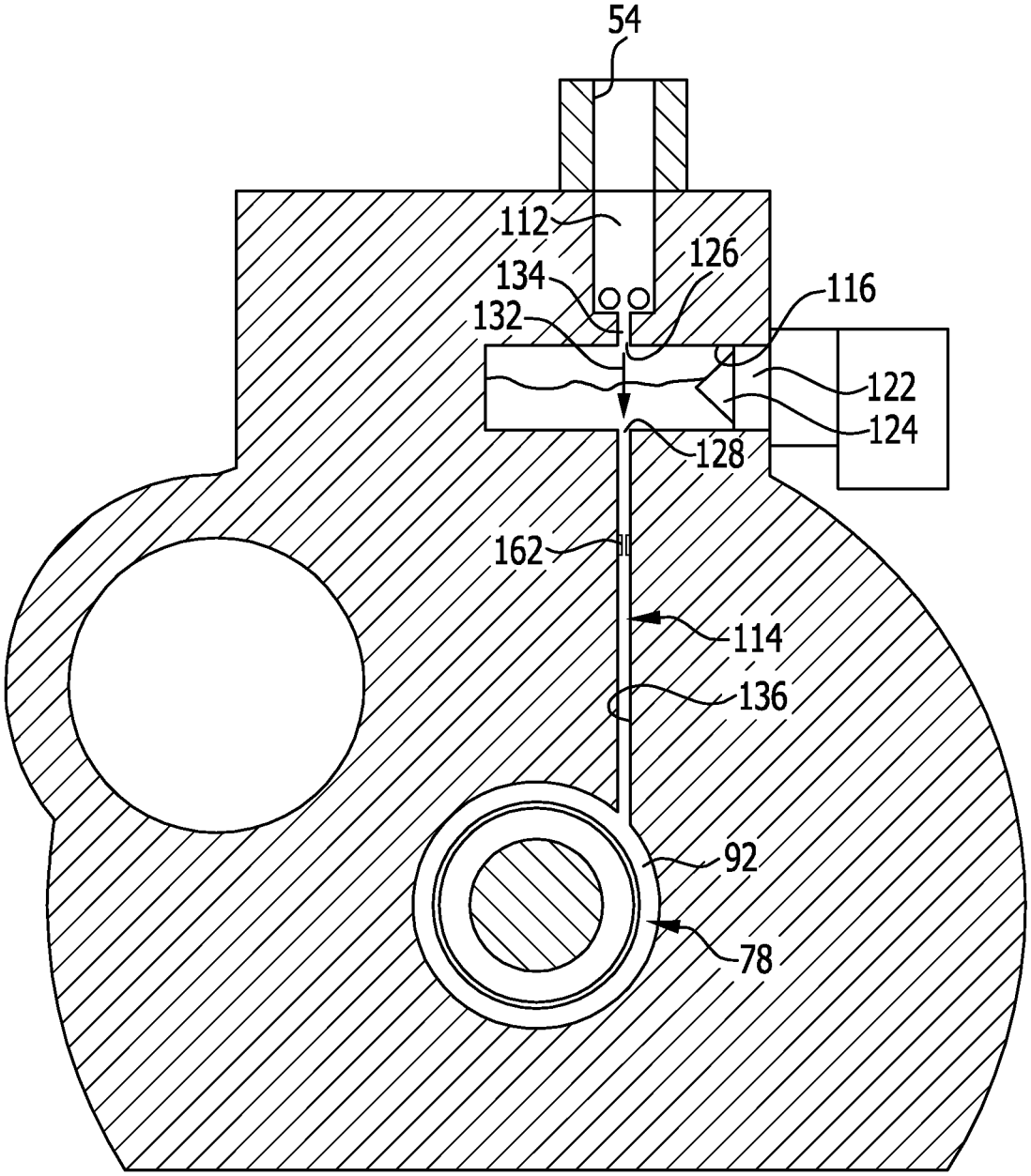
FIG. 3 shows a section along line 3-3 in FIG. 2.
Figure 4:
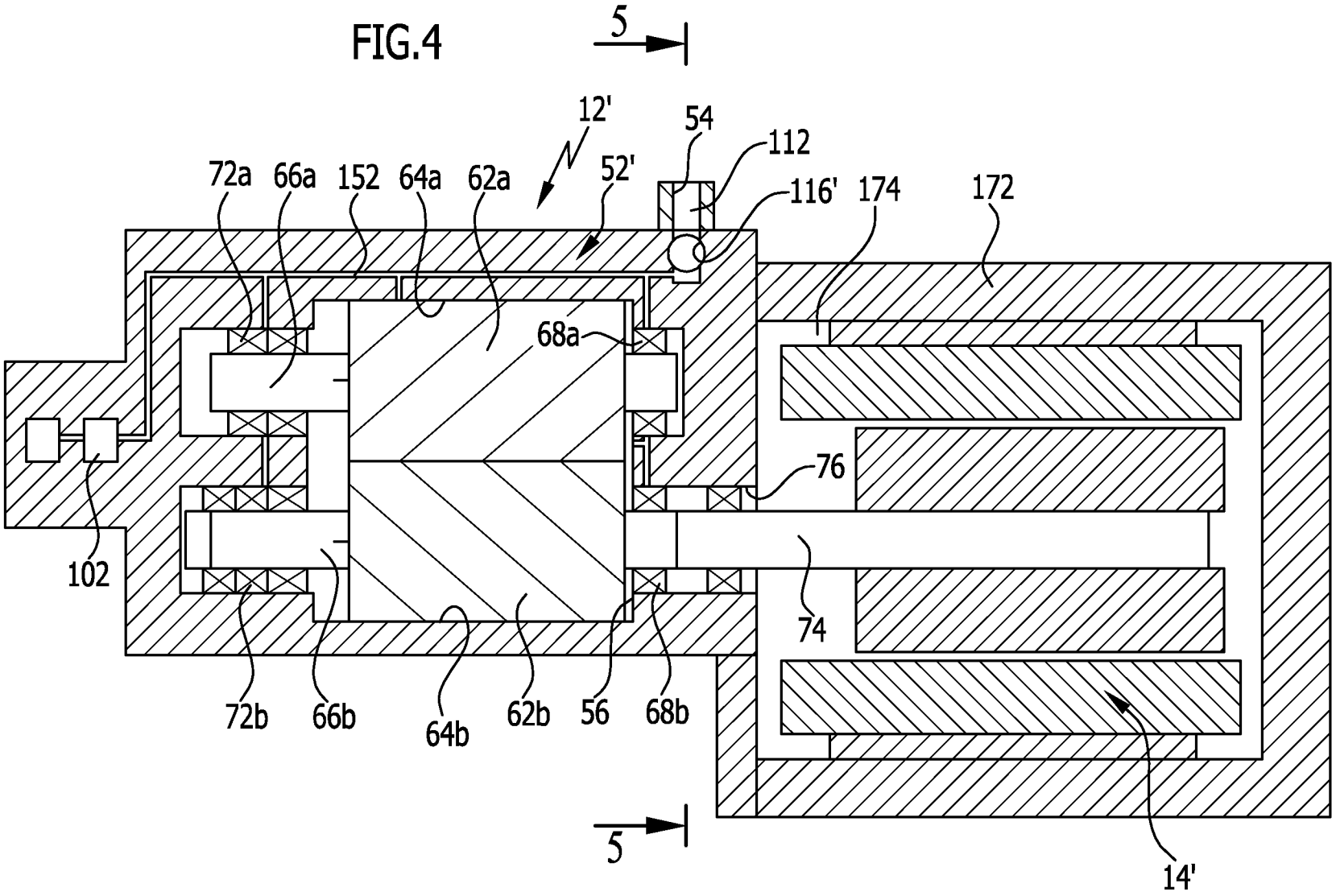
FIG. 4 shows a section similar to FIG. 2, through a second exemplary embodiment of a refrigerant compressor unit according to the invention.
Figure 5:
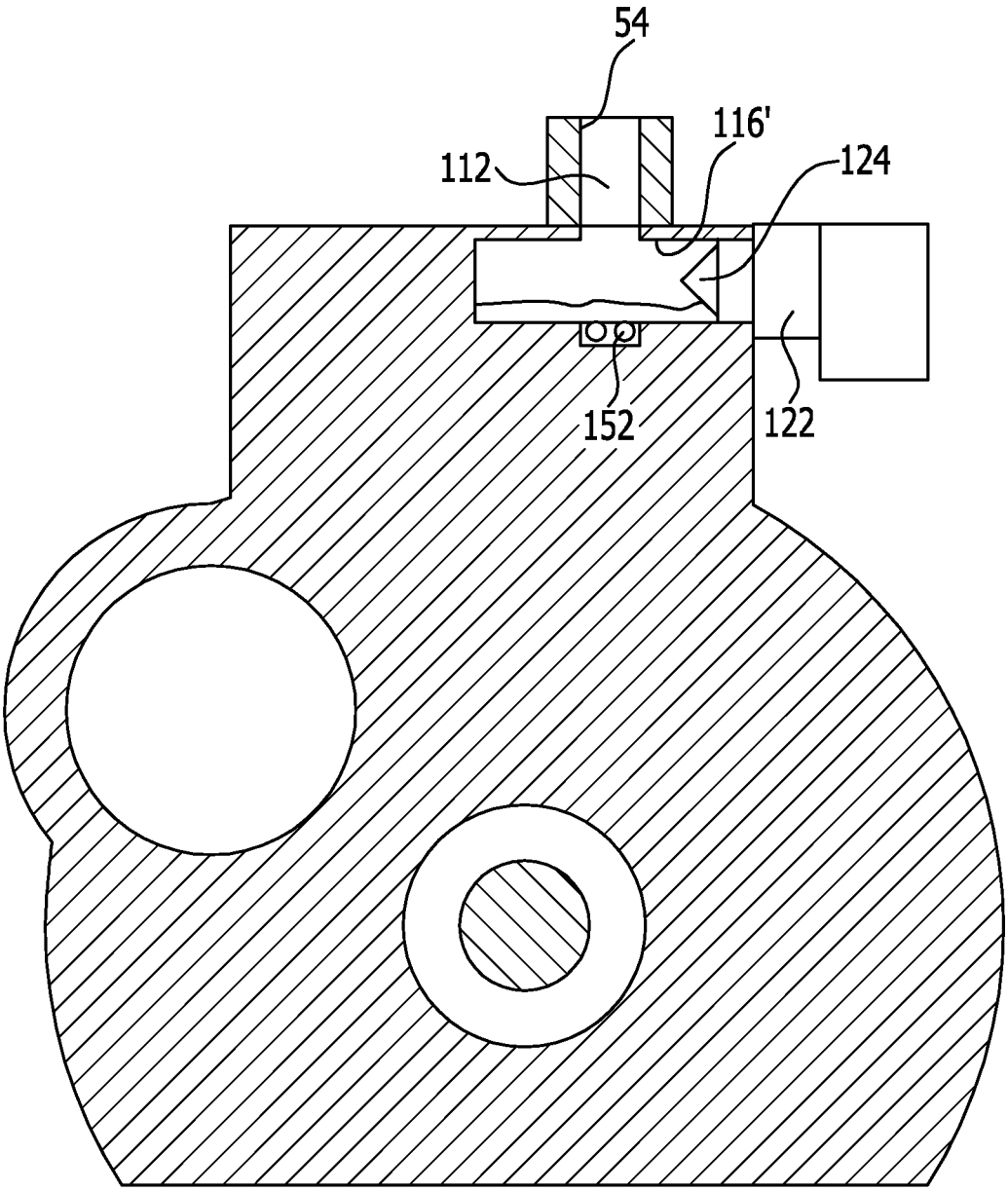
FIG. 5 shows a section along line 5-5 in FIG. 4.

From the connector chamber 112, for example a first lubricant supply line 114 extends to the lubricant supply chamber 92 of the shaft seal unit 78, wherein a lubricant storage chamber 116 is arranged in the first lubricant supply line 114, as illustrated for example in FIGS. 2 and 3.

The lubricant storage chamber 116 lies above the shaft seal unit 78, relative to the direction of gravity.

Associated with a lubricant monitor 120 is a lubricant presence sensor 122, which detects the presence of lubricant in the lubricant storage chamber 116, for example optically.

For this purpose, the lubricant presence sensor 122 is arranged in the lubricant storage chamber 116 and provided with a prism 124 that faces the lubricant in the lubricant storage chamber 116, wherein, if this prism 124 is adjacent to lubricant in the lubricant storage chamber 116, it reflects light falling thereon differently from the case in which there is no lubricant in the lubricant storage chamber 116 and so the prism 124 is not adjacent to lubricant.

These reflective properties of the prism 124 are detected by means of a light source arranged in the lubricant presence sensor 122 and by a corresponding detector of reflected light.

As illustrated in FIG. 3, the lubricant presence sensor 122 is arranged in the lubricant storage chamber 116 in particular such that it is arranged laterally offset from an entry opening 126 and an exit opening 128 of the lubricant storage chamber 116, with the result that the lubricant presence sensor 122 is arranged laterally offset from a lubricant stream 132 running through the lubricant storage chamber 116 directly from the entry opening 126 to the exit opening 128, and so does not obstruct the lubricant stream 132, and so also no restriction of the lubricant stream 132 and hence also no drop in pressure is brought about by the lubricant presence sensor 122.

The lubricant presence sensor 122, which is coupled to the lubricant monitor 120, communicates to the lubricant monitor 120 whether there is lubricant in the lubricant storage chamber 116 or not, and in the event that there is no lubricant in the lubricant storage chamber 116 the lubricant monitor 120 has the effect of switching off the motor 14 and hence the drive of the refrigerant compressor unit 12.

In the exemplary embodiment illustrated, the lubricant supply line 114 takes a form for example such that a duct section 134 runs from the connector chamber 112 to the entry opening 126, and a duct section 136 runs from the exit opening 128 to the lubricant supply chamber 92 of the shaft seal unit 78, wherein the duct sections 134 and 136 preferably have a smaller flow cross section than the flow cross section available to the lubricant in the lubricant storage chamber 116.

As an alternative to forming the lubricant presence sensor 122 as an optical sensor, it is also conceivable for it to take the form of a heated thermocouple that is cooled by contact with the lubricant and thus does not heat up substantially but is heated in the absence of contact with the lubricant, wherein this heating is detected and thus the absence of lubricant identified.

In the shaft seal unit 78, the lubricant passes through the shaft seal 86 and flows from the lubricant drainage chamber 94 through a lubricant outlet line, designated 142 as a whole, and through the mouth aperture 146 thereof on the suction side into the compressor chambers 64*a* and 64*b*, with the result that the lubricant is then able to lubricate the compressor elements 62*a* and 62*b* that operate in the compressor chambers 64*a* and 64*b*.

Preferably, a lubricant storage chamber 144 is also provided in the lubricant outlet line 142 and is also arranged above the shaft seal unit 78, relative to the direction of gravity.

Because the lubricant supply line 114 runs from the connector chamber 112, which lies above the shaft seal unit 78 relative to the direction of gravity, to the shaft seal unit 78, and because at least the lubricant storage chamber 144 in the lubricant outlet line 142 lies above the shaft seal unit 78 relative to the direction of gravity, there are lubricant volumes able to supply lubricant to the shaft seal unit 78 available in both the lubricant supply line 114 and in the lubricant outlet line 142, as a result of the action of gravity.

Thus, even if the lubricant supply system 40 delivers no more lubricant to the lubricant connector 54, or if there is no longer a pressure difference between the lubricant connector 54 and the mouth aperture 146, it is possible to make lubricant available to the shaft seal unit 78 for at least a transitional period, by way of the lubricant supply line 114 and the lubricant outlet line 142.

Preferably, the lubricant supply line 114 and the lubricant outlet line 142 are integrated into the compressor housing 52, in particular being arranged integrated into a housing wall region 148.

Preferably, the lubricant volume of the lubricant that lies above the shaft seal unit 78, relative to the direction of gravity, in the lubricant supply line 114 and the lubricant outlet line 142 is large enough for sufficient lubrication of the shaft seal unit 78 always to be ensured until the refrigerant compressor unit 12 comes to a standstill and/or until the refrigerant compressor unit 12 is started up again, both in the event of an interruption to the lubricant delivery because the motor 14 is switched off, and also in the event of the motor 14 being switched off because an absence of lubricant in the lubricant supply line 114 has been identified by the lubricant presence sensor 122.

In the first exemplary embodiment according to FIGS. 1, 2 and 3, the assumption is made that the lubricant supply points other than the shaft seal unit 78, formed for example by the bearings 68 on the suction side, the bearings 72 on the pressure side, the compressor elements 62 operating in the compressor chambers 64 and the slider units 102, are less sensitive to an interruption in the flow of lubricant, so a second lubricant supply line 152 to these lubricant supply points is not monitored by a lubricant presence sensor 122 but rather the assumption is made that, if the lubricant presence sensor 122 detects no lubricant and triggers switch-off of the drive for the refrigerant compressor unit 12, then no more lubricant is supplied to the lubricant supply line 152 either, but the lubricant volume available in the lubricant supply line 152, which runs above the lubricant supply points relative to the direction of gravity, is still sufficient to lubricate the lubricant supply points supplied thereby in the event of an interruption in the delivery of lubricant, wherein all these lubricant supply points ultimately discharge lubricant into the compressor chamber.

In the first exemplary embodiment, in particular in the case of the lubricant supply point formed by the shaft seal unit 78 but where appropriate also in the case of the other lubricant supply points, not only are these lubricant supply points lubricated but the element forming the respective lubricant supply point is also cooled, with the result that this makes no damage to the respective element and also the observance of a maximum temperature at the respective lubricant supply point possible.

In particular in the case of the shaft seal unit 78, it is necessary to cool it by an appreciable throughflow of lubricant.

So that this throughflow of lubricant can be established in defined manner, throttling elements 162 and 164 are provided for example in the lubricant supply line 114 and/or in the lubricant outlet line 142 respectively, and where there is the usual pressure difference between the lubricant connector 54 and, in this case, the mouth aperture 146 these throttling elements 162 and 164 keep the throughflow of lubricant at the level specified for sufficient cooling.

Preferably, providing the throttling element 162 in the lubricant supply line 114, for example in the duct section 136, has the advantage that it is easy to install.

Providing the throttling element 164 in the lubricant outlet line 142 has in particular the advantage that, as the refrigerant compressor unit 12 starts up and suction pressure is produced at the mouth aperture 146, the lubricant storage chamber 144 empties only in delayed manner if the throttling element 164 is arranged between the lubricant storage chamber 144 and the mouth aperture 146.

In a second exemplary embodiment of the refrigerant compressor unit 12' according to the invention, the motor 14' is arranged in a motor housing 172 that is connected to the compressor housing 52' such that it is refrigerant-tight, and in particular refrigerant flows through an interior chamber 174 in the motor housing, for example in order to cool the motor 14'.

In this case, the need for a shaft seal unit 78 is dispensed with, and thus the first lubricant supply line 114 and the lubricant outlet line 142 are also dispensed with.

For this reason, the lubricant storage chamber 116' in which supplied lubricant accumulates is associated with the second lubricant supply line 152 adjacent to the connector chamber 112.

The presence of lubricant in the lubricant storage chamber 116' is monitored by the lubricant presence sensor 122, wherein the lubricant presence sensor 122 has a similar form and operation to the lubricant presence sensor 122 of the first exemplary embodiment for example.

Thus, the lubricant stream through the second lubricant supply line 152 is likewise monitored by the lubricant presence sensor 122, and a break in the delivery of lubricant is identified such that the lubricant monitor 120 is able to switch off the motor 14' in the event of an interruption in the lubricant delivery in order to prevent damage to the lubricant supply points supplied by the lubricant supply line 152.

Otherwise, the second exemplary embodiment operates in a similar manner to the first exemplary embodiment, and the same reference numerals have been used for the same elements, with the result that, as regards the description of all these elements, reference may be made to the entire content of the statements made in respect of the first exemplary embodiment.

The invention claimed is:

1. A refrigerant compressor unit, including a compressor housing and at least one compressor element that is arranged in the compressor housing, is movable by bearing and drive parts, and operates in at least one compressor chamber, at least one lubricant supply point arranged in the compressor housing for at least one of the bearing and drive parts and/or compressor element, and a lubricant supply line to the at least one lubricant supply point, the lubricant supply line has a lubricant storage chamber through which lubricant flows and in which a lubricant presence sensor is arranged for detecting lubricant in the lubricant storage chamber.

2. The refrigerant compressor unit according to claim 1, wherein the lubricant presence sensor is an optical sensor.

3. The refrigerant compressor unit according to claim 2, wherein the lubricant storage chamber forms, in relation to rest of flow sections of the lubricant supply line, an unthrottled section, and takes a form having a widened cross section by comparison with the rest of the flow sections of the lubricant supply line.

4. The refrigerant compressor unit according to claim 1, wherein the optical lubricant presence sensor is arranged with a sensor surface that detects the presence of lubricant adjacent to the lubricant storage chamber.

5. The refrigerant compressor unit according to claim 1, wherein the lubricant supply line stores a volume of lubricant that lies above the lubricant supply point, relative to the direction of gravity.

6. The refrigerant compressor unit according to claim 5, wherein the lubricant storage chamber receives at least some of the volume of lubricant to be stored.

7. The refrigerant compressor unit according to claim 5, wherein the lubricant volume of the lubricant supply line is at least large enough, in the event that the drive of the refrigerant compressor unit is switched off, to ensure that lubricant is supplied to the lubricant supply point without any further delivery of lubricant until the refrigerant compressor unit comes to a final standstill.

8. The refrigerant compressor unit according to claim 7, wherein the lubricant volume is at least large enough to ensure that lubricant is supplied to the lubricant supply point without any further supply of lubricant until the refrigerant compressor unit is started up again.

9. The refrigerant compressor unit according to claim 5, wherein the lubricant volume of the lubricant supply line and the lubricant outlet line together is at least large enough, in the event that the drive of the refrigerant compressor unit is switched off, to ensure that lubricant is supplied to the lubricant supply point without any further delivery of lubricant until the refrigerant compressor unit comes to a final standstill.

10. The refrigerant compressor unit according to claim 9, wherein the lubricant volume of the lubricant supply line and the lubricant outlet line together is at least large enough to ensure that lubricant is supplied to the lubricant supply point without any further delivery of lubricant until the refrigerant compressor unit is started up again.

11. The refrigerant compressor unit according to claim 1, wherein the lubricant supply line is arranged integrated into the compressor housing.

12. The refrigerant compressor unit according to claim 11, wherein the lubricant supply line is arranged in a wall region of the compressor housing that accommodates the lubricant supply point.

13. The refrigerant compressor unit according to claim 1, wherein the lubricant supply line is connected to a lubricant connector provided on the compressor housing and fed by a lubricant supply system, and extends from the lubricant connector to the at least one lubricant supply point.

14. The refrigerant compressor unit according to claim 1, wherein the lubricant supply point is located at least one of the following elements: a shaft seal unit, a bearing unit, the compressor element that operates in the compressor chamber, and a slider unit.

15. The refrigerant compressor unit according to claim 1, wherein a throttling element is provided in the lubricant supply line.

16. The refrigerant compressor unit according to claim 1, wherein a throttling element is provided in the lubricant outlet line.

17. The refrigerant compressor unit according to claim 1, wherein the lubricant presence sensor is connected to a lubricant monitor which, in the event of an interruption in the delivery of lubricant that is detected by the presence sensor, switches off a drive of the refrigerant compressor unit.

18. The refrigerant compressor unit according to claim 17, wherein, in the event of an interruption in the delivery of lubricant that is detected by the lubricant presence sensor, the lubricant monitor switches off the motor for driving the refrigerant compressor unit.

19. A refrigerant compressor unit, including a compressor housing and at least one compressor element that is arranged in the compressor housing, is movable by bearing and drive parts, and operates in at least one compressor chamber, at least one lubricant supply point arranged in the compressor housing for at least one of the bearing and drive parts and/or compressor element, and a lubricant supply line to the at least one lubricant supply point, the lubricant supply line has a lubricant storage chamber through which lubricant flows and in which a lubricant presence sensor is arranged for detecting lubricant in the lubricant storage chamber, wherein a lubricant outlet line runs from the lubricant supply point to the at least one compressor chamber of the compressor housing.

20. The refrigerant compressor unit according to claim 19, wherein the lubricant outlet line has the lubricant storage chamber for accommodating the lubricant.

21. The refrigerant compressor unit according to claim 19, wherein the lubricant outlet line stores a volume of lubricant that lies above the lubricant supply point, relative to the direction of gravity.

22. The refrigerant compressor unit according to claim 21, wherein the lubricant storage chamber accommodates at least some of the volume of lubricant to be stored.

23. The refrigerant compressor unit according to claim 21, wherein the lubricant volume of the lubricant outlet line is at least large enough, in the event that the drive of the refrigerant compressor unit is switched off, to ensure that lubricant is supplied to the lubricant supply point without any further delivery of lubricant until the refrigerant compressor unit comes to a final standstill.

24. The refrigerant compressor unit according to claim 23, wherein the lubricant volume is at least large enough to ensure that lubricant is supplied to the lubricant supply point without any further delivery of lubricant until the refrigerant compressor unit is started up again.

25. A refrigerant compressor unit, including a compressor housing and at least one compressor element that is arranged in the compressor housing, is movable by bearing and drive parts, and operates in at least one compressor chamber, at least one lubricant supply point arranged in the compressor housing for at least one of the bearing and drive parts and/or compressor element, and a lubricant supply line to the at least one lubricant supply point, the lubricant supply line has a lubricant storage chamber through which lubricant flows and in which a lubricant presence sensor is arranged for detecting lubricant in the lubricant storage chamber, wherein the lubricant outlet line is arranged integrated into the compressor housing.

26. The refrigerant compressor unit according to claim 25, wherein the lubricant outlet line is arranged in the wall region of the compressor housing that accommodates the lubricant supply point.

* * * * *